US010378336B2

(12) United States Patent
Marvel et al.

(10) Patent No.: US 10,378,336 B2
(45) Date of Patent: Aug. 13, 2019

(54) SYSTEM AND METHOD FOR REAL-TIME CONDITION MONITORING OF AN ELECTRIC SUBMERSIBLE PUMPING SYSTEM

(71) Applicant: GE Oil & Gas ESP, Inc., Oklahoma City, OK (US)

(72) Inventors: Robert Lee Marvel, Oklahoma City, OK (US); Tyler Walker, Oklahoma City, OK (US); Samved Bhatnagar, Houston, TX (US)

(73) Assignee: GE Oil & Gas Esp, Inc., Oklahoma City, OK (US)

( * ) Notice: Subject to any disclaimer, the term of this patent is extended or adjusted under 35 U.S.C. 154(b) by 0 days.

(21) Appl. No.: 15/561,247

(22) PCT Filed: Mar. 25, 2015

(86) PCT No.: PCT/US2015/022517
§ 371 (c)(1),
(2) Date: Sep. 25, 2017

(87) PCT Pub. No.: WO2016/153503
PCT Pub. Date: Sep. 29, 2016

(65) Prior Publication Data

US 2018/0051555 A1 Feb. 22, 2018

(51) Int. Cl.
*E21B 47/00* (2012.01)
*E21B 47/12* (2012.01)
(Continued)

(52) U.S. Cl.
CPC ..... *E21B 47/122* (2013.01); *E21B 43/128* (2013.01); *E21B 47/00* (2013.01);
(Continued)

(58) Field of Classification Search
CPC .. E21B 47/00; E21B 47/0007; E21B 47/0008; E21B 47/06; E21B 47/065;
(Continued)

(56) References Cited

U.S. PATENT DOCUMENTS 5,706,896 A 1/1998 Tubel et al.
6,873,267 B1 3/2005 Tubel et al.
(Continued)

FOREIGN PATENT DOCUMENTS

CA 2 899 842 A1 10/2014
RU 2307954 C2 10/2007
(Continued)

OTHER PUBLICATIONS

International Search Report and Written Opinion issued in connection with corresponding PCT application No. PCT/US2015/022517 dated Dec. 18, 2015.
(Continued)

*Primary Examiner* — Andrew W Bee
(74) *Attorney, Agent, or Firm* — Laura L. Pollander

(57) ABSTRACT

A pumping system for use in a subterranean wellbore below a surface includes a motor assembly, a pump driven by the motor assembly, and one or more sensors configured to measure an operating parameter within the pumping system and output a signal representative of the measured parameter. The pumping system further includes a wireless telemetry system that is configured to transmit data representative of the measured parameter from the pumping system to the surface. The one or more sensors may include acoustically active sensors that operate according to surface acoustic wave principles.

20 Claims, 4 Drawing Sheets

(51) Int. Cl.

| | |
|---|---|
| ***E21B 47/06*** | (2012.01) |
| ***E21B 47/16*** | (2006.01) |
| ***E21B 47/14*** | (2006.01) |
| ***F04D 13/10*** | (2006.01) |
| ***F04D 15/00*** | (2006.01) |
| ***E21B 43/12*** | (2006.01) |
| ***E21B 47/18*** | (2012.01) |

(52) U.S. Cl.
CPC ..... *E21B 47/0007* (2013.01); *E21B 47/0008* (2013.01); *E21B 47/06* (2013.01); *E21B 47/065* (2013.01); *E21B 47/12* (2013.01); *E21B 47/14* (2013.01); *E21B 47/16* (2013.01); *E21B 47/18* (2013.01); *F04D 13/10* (2013.01); *F04D 15/0088* (2013.01)

(58) Field of Classification Search
CPC ..... E21B 47/12; E21B 47/14; E21B 47/16; E21B 47/18
See application file for complete search history.

(56) References Cited

U.S. PATENT DOCUMENTS

| | | | | |
|---|---|---|---|---|
| 7,669,651 | B1 | 3/2010 | Carstensen | |
| 7,905,702 | B2 | 3/2011 | Stabley | |
| 7,979,240 | B2 | 7/2011 | Fielder | |
| 8,043,054 | B2 | 10/2011 | D et al. | |
| 8,075,267 | B2 | 12/2011 | Enevoldsen | |
| 8,123,480 | B2 | 2/2012 | Enevoldsen | |
| 8,380,642 | B2 | 2/2013 | Stundner et al. | |
| 2003/0086336 | A1* | 5/2003 | Dubinsky ..... | E21B 47/18 367/76 |
| 2003/0192692 | A1 | 10/2003 | Tubel | |
| 2007/0114040 | A1 | 5/2007 | Jamieson et al. | |
| 2007/0175633 | A1 | 8/2007 | Kosmala et al. | |
| 2011/0186290 | A1 | 8/2011 | Roddy et al. | |
| 2012/0020808 | A1 | 1/2012 | Lawson et al. | |
| 2012/0121383 | A1 | 5/2012 | Michligk | |
| 2013/0151156 | A1 | 6/2013 | Noui-Mehidi et al. | |
| 2013/0154847 | A1* | 6/2013 | Potyrailo ..... | E21B 47/10 340/856.3 |
| 2013/0175030 | A1 | 7/2013 | Ige et al. | |
| 2014/0158347 | A1 | 6/2014 | Fielder | |
| 2014/0262233 | A1 | 9/2014 | Keizer | |

FOREIGN PATENT DOCUMENTS

| | | | |
|---|---|---|---|
| RU | 2455460 | C2 | 7/2012 |
| RU | 2519537 | C2 | 6/2014 |
| WO | 2007/085783 | A1 | 8/2007 |
| WO | 2007/107815 | A1 | 9/2007 |
| WO | 2009/017900 | A2 | 2/2009 |

OTHER PUBLICATIONS

Stevens, D.S., et al., "Applications of Wireless Temperature Measurement Using SAW Resonators ," pp. 1-7 (Feb. 4, 2010).
"Wireless Passive SAW Temperature Sensor," Sandia National Laboratories, Retrieved from the Internet: https://web.archive.org/web/20121010191555/http://www.sandia.gov/mstc/MsensorSensorMsystems/documents/Wireless.pdf, pp. 1-2, (Sep. 26, 2018).
Office Action and Search Report issued in connection with corresponding RU Application No. 2017133141 dated Aug. 7, 2018.
Extended European Search Report and Opinion issued in connection with corresponding EP Application No. 15886658.2 dated Aug. 31, 2018.

* cited by examiner

SYSTEM AND METHOD FOR REAL-TIME CONDITION MONITORING OF AN ELECTRIC SUBMERSIBLE PUMPING SYSTEM

FIELD OF INVENTION

This invention relates generally to the field of electric submersible pumping systems, and more particularly, but not by way of limitation, to a submersible pumping system that includes a system and method of active real-time condition monitoring using on-board data acquisition and wireless telemetry.

BACKGROUND OF THE INVENTION

Electric submersible pumping systems are often deployed into wells to recover petroleum fluids from subterranean reservoirs. Typical electric submersible pumping systems include a number of components, including one or more fluid filled electric motors coupled to one or more high performance pumps located above the motor. In many instances, downhole components and tools are subjected to high-temperature, corrosive environments, which often lead to failure of these components. Downhole sensors are needed to provide reliable data regarding the physical, thermal and chemical properties of the components and downhole conditions.

Current downhole sensors used to transmit data about the downhole components and characteristics require cable attachments and connectors connected to the various components. Typically these sensors are not able to provide information about the state of the components during operation of the submersible pumping system and attempts to measure downhole characteristics during operation often results in errors due to indirect measurements. Further, sensors are often located on large, bulky instrumentation and require intrusive methods to measure downhole characteristics. For example, lateral shaft displacements of an electric submersible pump motor is often monitored by penetrating through the stator of the motor with some type of position sensor.

There is, therefore, a need for an improved wireless monitoring system to provide more accurate, real-time condition monitoring of the downhole components during operation of the submersible pumping system. It is to this and other needs that embodiments of the invention are directed.

SUMMARY OF THE INVENTION

In an embodiment, the present invention includes a pumping system for use in a subterranean wellbore below a surface. The pumping system includes a motor assembly, a pump driven by the motor assembly, and one or more sensors configured to measure an operating parameter within the pumping system and output a signal representative of the measured parameter. The pumping system further includes a wireless telemetry system that is configured to transmit data representative of the measured parameter from the pumping system to the surface.

In another aspect, embodiments include a method for monitoring physical parameters within a pumping system deployed in a wellbore. The method includes the steps of providing an acoustically active sensor within the pumping system, providing an interrogator in wireless communication with the acoustically active sensor, and providing a control unit in communication with the interrogator. The method continues with the steps of transmitting an incident wireless signal from the interrogator, receiving the incident wireless signal at the acoustically active sensor and reflecting from the acoustically active sensor a reflected wireless signal, where the reflected wireless signal has been affected by the physical parameter acting on the acoustically active sensor. The method concludes with the steps of receiving the reflected wireless signal with the interrogator and interpreting the differences between the incident wireless signal and the reflected wireless signal as a measurement of the physical parameter acting on the acoustically active sensor.

In yet another aspect, embodiments include a method for monitoring physical parameters of a pumping system deployed in a wellbore below the surface from a control unit located on the surface. The method includes the steps of providing a sensor within the pumping system, measuring a condition within the pumping system with the sensor, providing a transmitter operably connected to the sensor and providing a receiver at a spaced apart distance from the transmitter within the pumping system. The method continues with the step of transmitting a primary wireless data signal from the transmitter to the receiver that is representative of the measured condition. The method concludes with the step of transmitting a data secondary signal to the control unit on the surface from the receiver, where the secondary signal is representative of the measured condition.

DETAILED DESCRIPTION OF THE INVENTION

Figure 1:
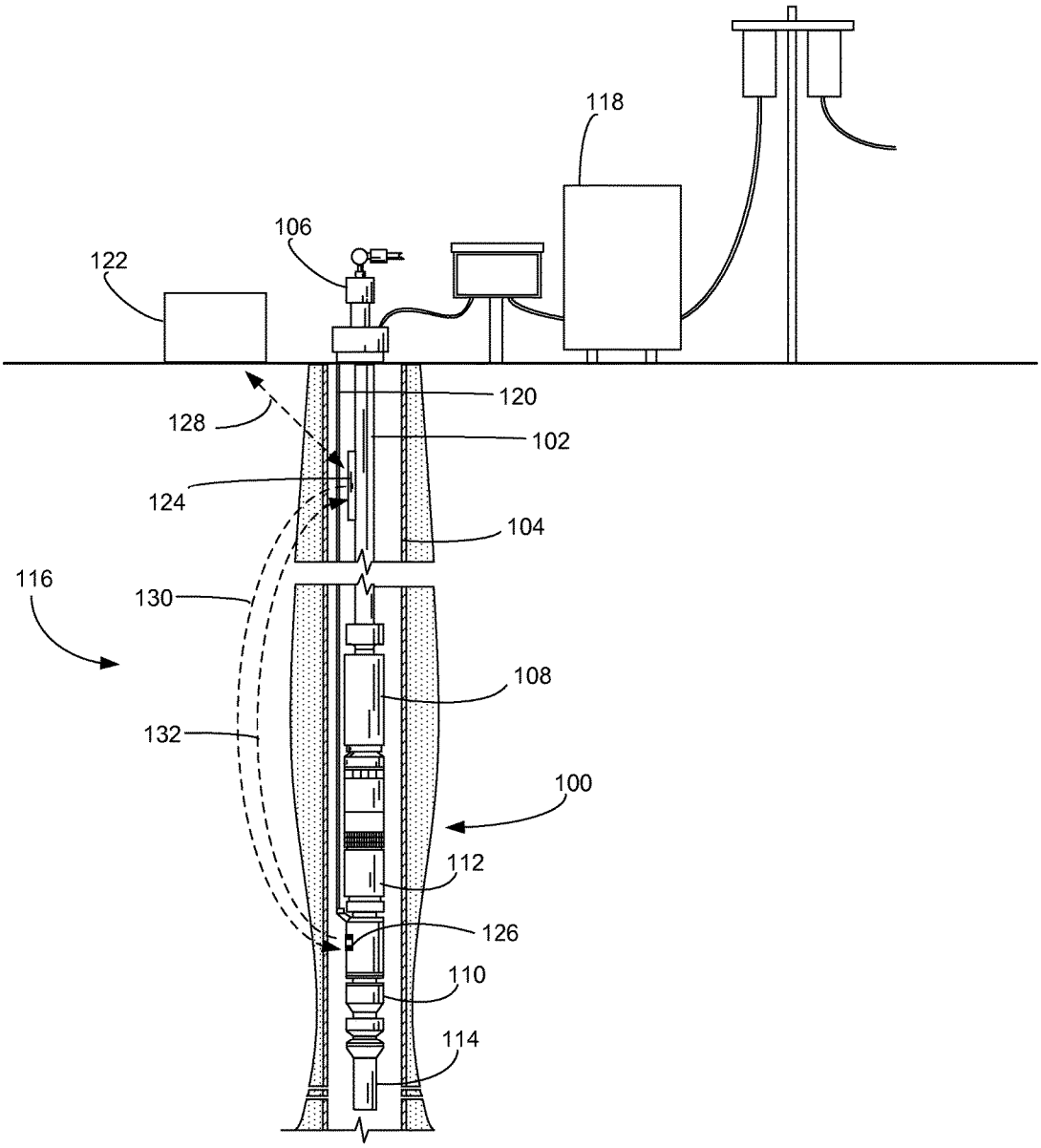
FIG. 1 is a depiction of a pumping system constructed in accordance with an embodiment.

In accordance with an embodiment of the present invention, FIG. 1 shows an elevational view of a pumping system 100 attached to production tubing 102. The pumping system 100 and production tubing 102 are disposed in a wellbore 104, which is drilled for the production of a fluid such as water or petroleum. As used herein, the term "petroleum" refers broadly to all mineral hydrocarbons, such as crude oil, gas and combinations of oil and gas. The production tubing 102 connects the pumping system 100 to a wellhead 106 located on the surface. Although the pumping system 100 is primarily designed to pump petroleum products, it will be understood that the present invention can also be used to move other fluids. It will also be understood that, although each of the components of the pumping system are primarily disclosed in a submersible application, some or all of these components can also be used in surface pumping operations.

The pumping system 100 in an embodiment includes a pump assembly 108, a motor assembly 110, a seal section 112, a sensor array module 114 and a wireless telemetry system 116. The motor assembly 110 is in an embodiment an electrical motor that receives power from a surface-mounted variable speed drive 118 through a power cable 120. When energized, the motor assembly 110 drives a shaft that causes the pump assembly 108 to operate. The seal section 112 shields the motor assembly 110 from mechanical thrust produced by the pump assembly 108 and provides for the expansion of motor lubricants during operation. The seal section 112 also isolates the motor assembly 110 from the wellbore fluids passing through the pump assembly 108. The sensor array module 114 is in an embodiment placed below the motor assembly 110 and is configured to measure and evaluate a number of parameters internal and external to the motor assembly 110. Such parameters include, for example, wellbore temperature, wellbore static pressure, gas-to-liquid ratios, internal operating temperature, vibration, radiation, motor winding conductivity, motor winding resistance and motor operating speed. It will be appreciated that the sensor array module 114 may also be connected to sensors placed in other locations within the pumping system 100. For example, the sensor array module 114 can be connected to sensors in the seal section 112 and pump 108 for monitoring intake and discharge pressures and internal operating temperatures.

The wireless telemetry system 116 provides a communication system for sending and receiving information between the pumping system 100 and surface facilities using acoustic, radio or other wireless signal telemetry. In an embodiment depicted in FIG. 1, the wireless telemetry system 116 includes a surface-mounted control unit 122, an interrogator 124 and one or more acoustically active sensors 126. The control unit 122 in an embodiment includes an onboard computer that controls the operation of the wireless telemetry system 116, stores information retrieved through the wireless telemetry system 116 and provides information to the variable speed drive 118 and other downstream computer systems and operator interfaces.

In response to a command signal 128 from the control unit 122, the interrogator 124 emits an incident acoustic wave 130. The incident acoustic wave 130 is received by the acoustically active sensors 126. In response to the incident acoustic wave 130, the acoustically active sensors 126 produce a reflected acoustic wave 132 that is received by the interrogator 124. Unless otherwise limited, the term "reflected" will be used herein to refer broadly to waves that are produced directly or indirectly in response to the incident acoustic wave 130, including waves that are only reflected as well as waves that are transmitted, amplified, or otherwise transformed from the incident acoustic wave 130. The differences between the incident acoustic wave 130 and the reflected acoustic wave 132 present information about the measurement taken by the acoustically active sensor. The interrogator 124 can be configured to interpret the reflected acoustic wave 132 and provide an interpreted result to the control unit 122 or simply relay the reflected acoustic wave 132 to the control unit 122 for interpretation. It will be appreciated that the interrogator 124 can be placed in the wellbore 104, on the pumping system 100 or on the surface. It will be further appreciated that the command signal 128 can be transmitted to the interrogator 124 from the control unit 122 through a wired or wireless transmission.

As illustrated in FIG. 1, the signal between the acoustically active sensor 126 and the interrogator 124 passes through the wellbore 104 or surrounding reservoir. In an embodiment, the signal connection between the acoustically active sensor 126 and interrogator 124 can be configured to pass through the pumping system 100 and production tubing 102 by adjusting the frequency, wavelength, energy and other characteristics of the acoustic signal. Non-signal noise created by other components within the pumping system 100 can be filtered out at the interrogator 124 or at the control unit 122 on the surface.

Figure 2:
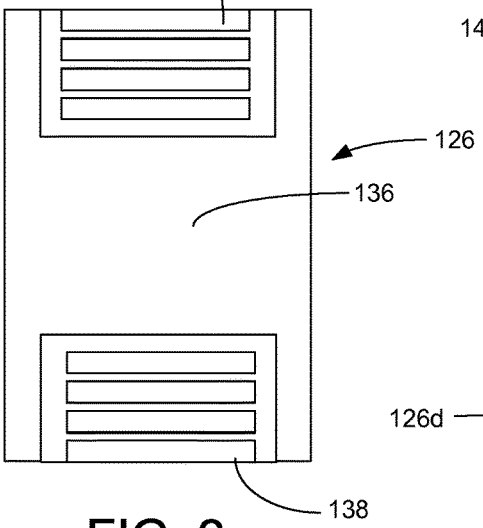
FIG. 2 is a depiction of the acoustically active sensors of the pumping system 100 of FIG. 1.
Figure 3:
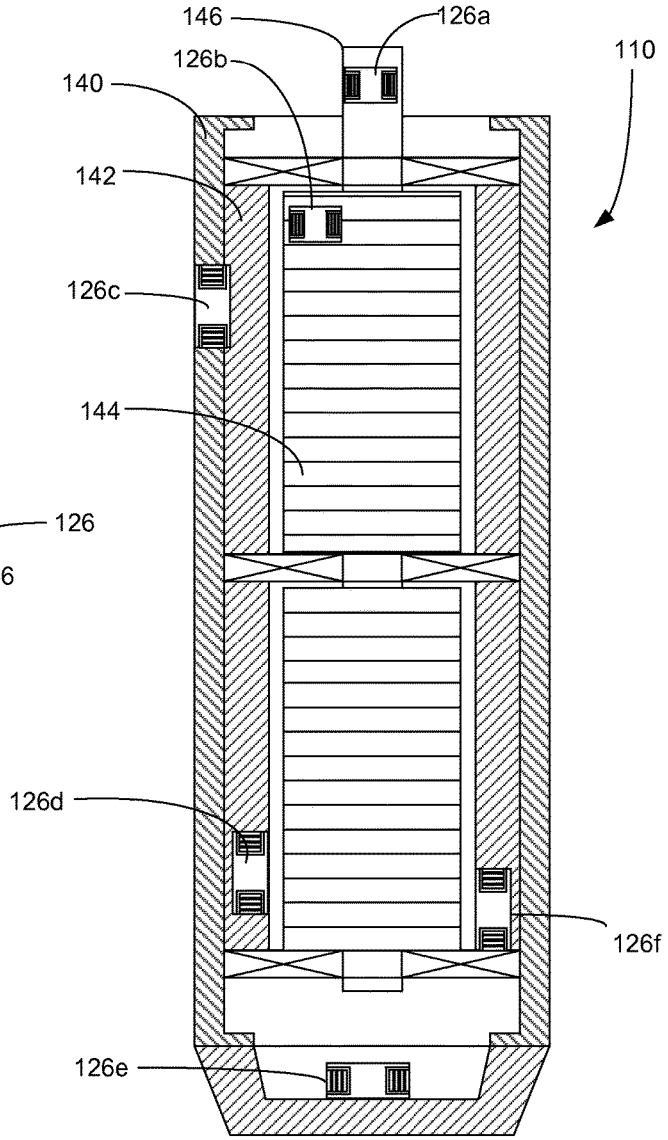
FIG. 3 is a partial cross-sectional view of the motor assembly of FIG. 1 with acoustically active sensors.

Turning to FIGS. 2 and 3, shown therein is an embodiment of an acoustically active sensor 126 and a cross-sectional depiction of the motor assembly 110. The acoustically active sensor 126 is in an embodiment a surface acoustic wave (SAW) sensor that includes an input transducer 134, a delay field 136 and an output transducer 138. Each acoustically active sensor 126 is a micro-electromechanical system that relies on the modulation of surface acoustic waves to sense and measure a physical parameter such as temperature, stress and strain, ultraviolet radiation, current, magnetic fields and voltage. The input transducer 134 receives the incident acoustic wave 130 and directs the wave energy along the delay field 136. As the acoustic wave passes along the delay field 136, the measured parameter (e.g., temperature, strain, radiation, current, magnetism, or voltage) affects the wave travel. The affected acoustic wave is then passed to the output transducer 138, which sends the reflected acoustic wave 132 back to the interrogator 124. The effect of the measured parameter on the passage of the transduced wave through the delay field 136 can be interpreted as a measurement of the underlying physical parameter. Although embodiments employ the use of an incident acoustic wave 130 and a reflected acoustic wave 132, it will be appreciated that in embodiments of the present invention the acoustically active sensors 126 are configured to receive and transmit waves of electromagnetic radiation. Such waves of electromagnetic radiation may include, for example, radio and microwave radiation.

FIG. 3 illustrates the placement of the acoustically active sensors 126 in the motor assembly 110. The motor assembly 110 an embodiment includes a housing 140, a stator 142, a rotor 144 and a shaft 146. In response to the passage of multiphase alternating electrical current through windings in the stator 142, the rotor 144 and shaft 146 rotate in accordance with well-established electromotive principles.

In embodiments, the acoustically active sensor **126*a* is placed on the shaft 146 in a way that the delay field 136 measures strain on the shaft 122. Acoustically active sensor 126*b* is secured to the rotor 144 and configured to measure bar-to-bar conductance within the rotor 144. Acoustically active sensor 126*c* is placed in the housing 140 and configured to measure the external temperature of the wellbore 104 around the motor 110. Acoustically active sensor 126*d* is secured within the stator 142 and configured to measure winding-to-winding electrical current. Acoustically active sensor 126*e* is secured within the base of the motor 110 and configured to measure the temperature of the motor lubricant circulating through the motor 110. Acoustically active sensor 126*f* is secured within the stator 142 and is configured to measure vibration within the motor assembly 110. It will be appreciated the motor assembly 110 may include additional acoustically active sensors 126 in alternative locations and in configurations designed to evaluate additional physical parameters. Furthermore, the acoustically active sensors 126 can be placed in the wellbore 104, the production tubing 102, on surface facilities and in other components within the pumping system 100**.

The interrogator 124 in an embodiment polls the acoustically active sensors 126 on a high-frequency basis. In an embodiment, the interrogator 124 uses frequency domain protocols for differentiating signals sent and received from individual acoustically active sensors 126. In an embodiment, the interrogator 124 uses time domain protocols for differentiating signals sent and received from individual acoustically active sensors 126. The interrogator 124 can be configured to poll multiple acoustically active sensors 126 simultaneously or multiple interrogators 124 can be used in concert to communicate with multiple acoustically active sensors 126.

The use of the acoustically active sensors 126 and the remote interrogator 124 provides an enhanced monitoring system that is non-intrusive and makes possible the real-time, high-resolution monitoring of components within the pumping system 100 and wellbore 104.

Figure 4:
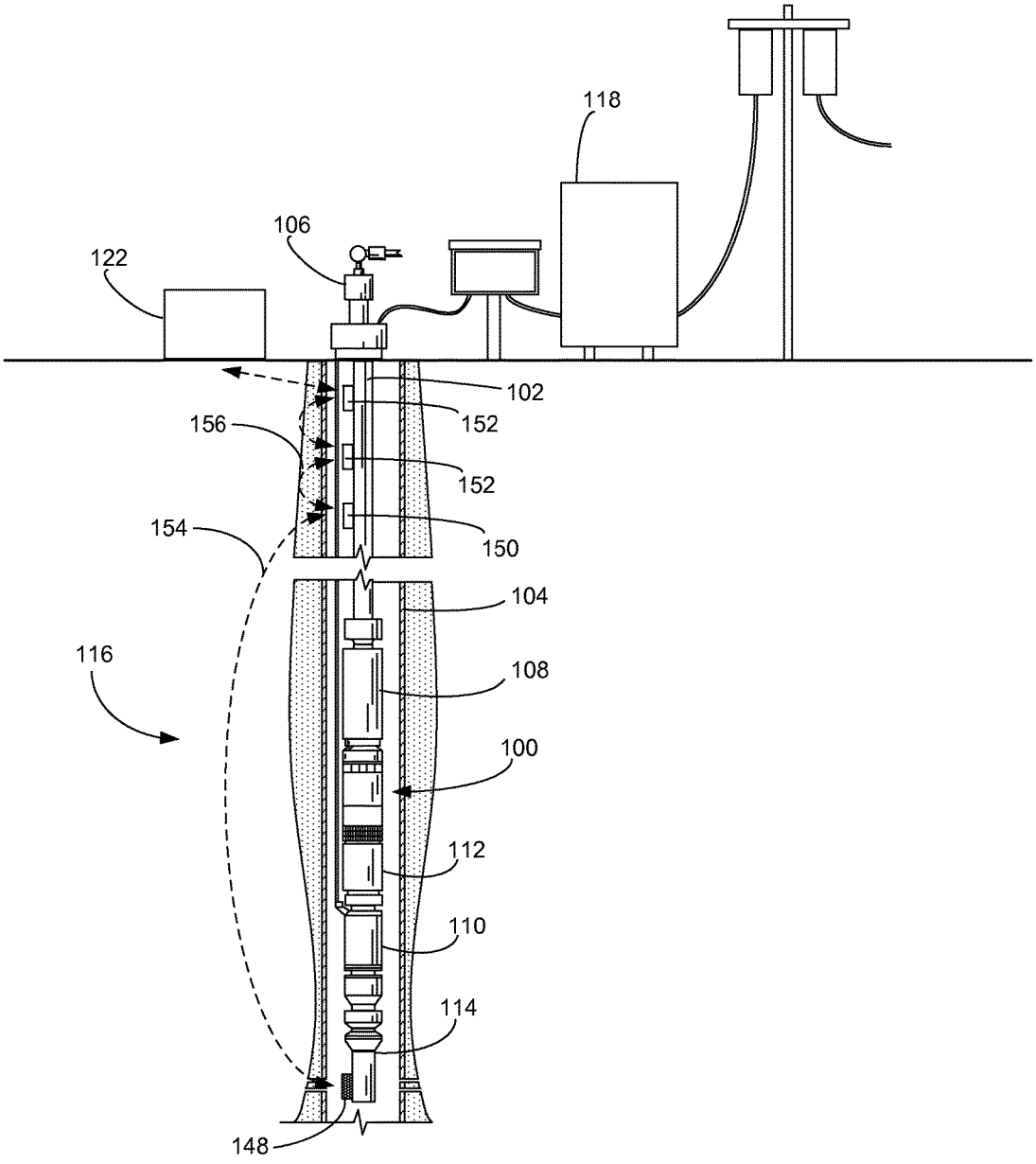
FIG. 4 is a depiction of a pumping system with wireless telemetry system constructed in accordance with an embodiment.

Turning to FIG. 4, shown therein is an embodiment of the pumping system 100 in which the wireless telemetry system 116 includes a transmitter 148, a receiver 150 and one or more repeaters 152. The transmitter 148 is operably connected to the sensor array module 114. Data collected by sensors within the pumping system 100 is aggregated at the array module 114 and passed to the transmitter 148. The transmitter 148 converts the measurement data into a primary data signal 154 that is transmitted to the receiver 150. In embodiments, the receiver 150 is positioned at or near the top of the pumping system 100. The receiver 150 converts the primary data signal 154 into a secondary data signal 156 that is transmitted by the receiver 150 directly to the surface control unit 122 or indirectly through the one or more repeaters 152. The surface control unit 122 interprets the secondary data signal 156 and provides the variable speed drive 118 or operator with information about the measurements taken from the wellbore 104 and pumping system 100.

As illustrated in FIG. 4, the signal between the transmitter 148 and the receiver 150 passes through the wellbore 104 or surrounding reservoir. In an embodiment, the signal connection between the transmitter 148 and the receiver 150 can be configured to pass through the pumping system 100 and production tubing 102 by adjusting the frequency, wavelength, energy and other characteristics of the acoustic signal. Non-signal noise created by other components within the pumping system 100 can be filtered out at the interrogator 124 or at the control unit 122 on the surface.

In an embodiment, the transmitter 148, receiver 150 and repeaters 152 are configured to send and receive radio signals and the primary and secondary data signals 154, 156 constitute radio signals. In an embodiment, the transmitter 148, receiver 150 and repeaters 152 are configured to send and receive acoustic signals and the primary and secondary data signals 154, 156 constitutes acoustic signals. In an embodiment, the primary data signal 154 is an acoustic signal and the secondary data signal 156 is a radio signal. In an embodiment, the primary data signal 154 is a radio signal and the secondary data signal 156 is a radio signal.

Figure 5:
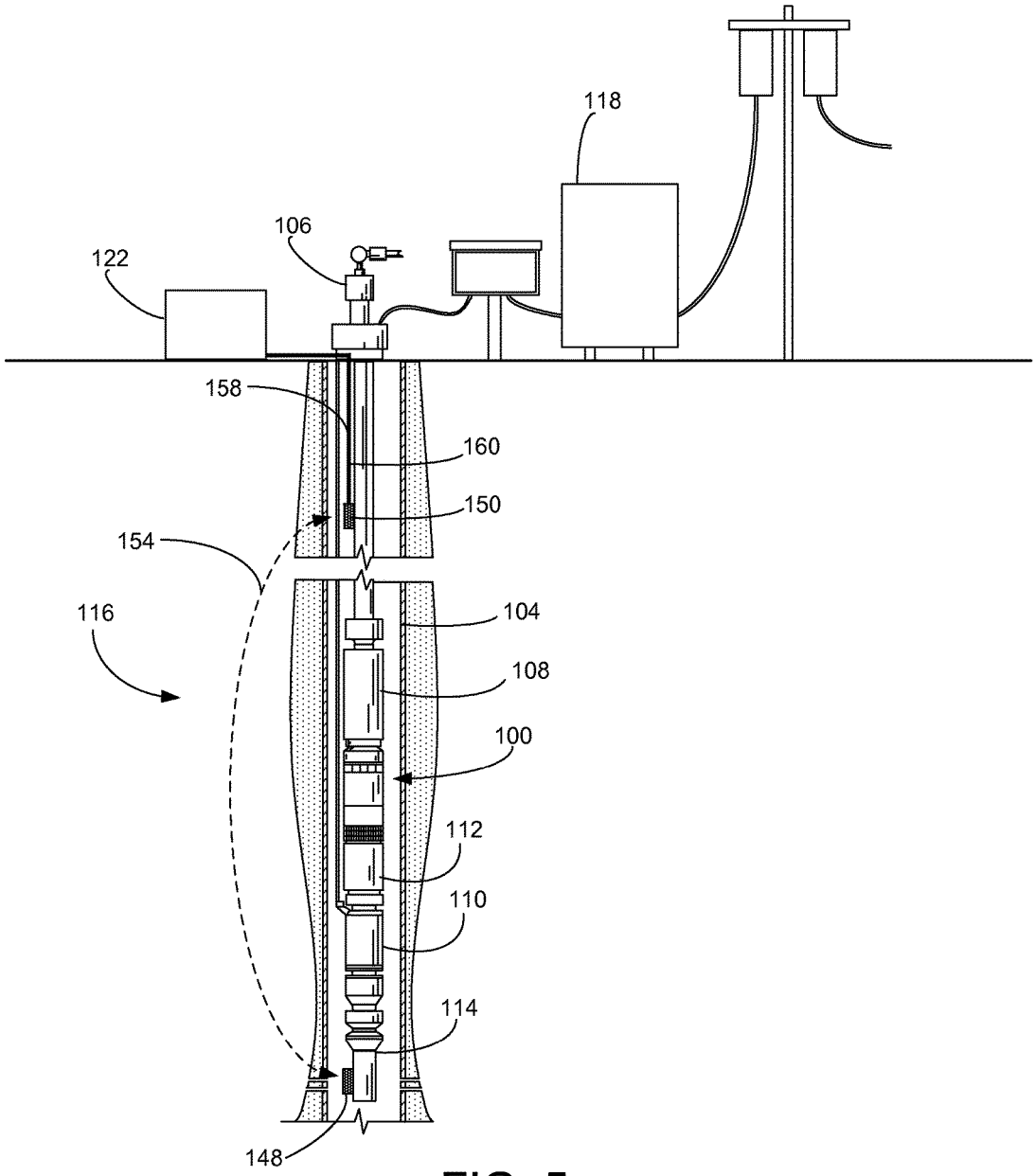
FIG. 5 is a depiction of a pumping system with wireless telemetry system constructed in accordance with an embodiment.

Turning to FIG. 5, shown therein is an embodiment of the pumping system 100 and wireless telemetry system 116. In the embodiment depicted in FIG. 5, the transmitter 148 sends the primary wireless data signal 154 that is representative of data collected by the pumping system 100 to the receiver 150. The receiver 150 is in an embodiment positioned above the pumping system 100 in the wellbore 104. The receiver 150 converts the primary wireless data signal 154 to a wired secondary data signal 158 that is transmitted to the surface control unit 122 through a data cable 160. Thus, in the alternate embodiment depicted in FIG. 5, the wireless telemetry system 116 provides a primary wireless data signal 154 around the pumping system 100 and relies on a wired secondary data signal 158 to the surface. This embodiment realizes the benefit of avoiding data cabling in the restricted space between the wellbore 104 and the pumping system 100, but employs a wired data cable 160 to the receiver 150. In certain applications, the use of a wired data cable 160 may be more cost effective than the use of multiple repeaters 152 positioned throughout the wellbore 104.

As illustrated in FIG. 5, the signal between the transmitter 148 and the receiver 150 passes through the wellbore 104 or surrounding reservoir. In an embodiment, the signal connection between the transmitter 148 and the receiver 150 can be configured to pass through the pumping system 100 and production tubing 102 by adjusting the frequency, wavelength, energy and other characteristics of the acoustic signal. Non-signal noise created by other components within the pumping system 100 can be filtered out at the interrogator 124 or at the control unit 122 on the surface.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A pumping system for use in a subterranean wellbore below a surface, the pumping system comprising:

a motor assembly;

a pump driven by the motor assembly;

one or more sensors configured to measure an operating parameter within the pumping system and output a signal representative of the measured parameter, wherein the one or more sensors comprises an acoustically active sensor; and a wireless telemetry system, wherein the wireless telemetry system is configured to transmit data representative of the measured parameter from the pumping system to the surface, wherein the wireless telemetry system comprises an interrogator in wireless communication with the acoustic active sensor and a control unit in communication with the interrogator, wherein the wireless telemetry system is configured to transmit an incident wireless signal from the interrogator, receive the incident wireless signal at the acoustically active sensor, and reflect from the acoustically active sensor a reflected wireless signal, wherein the reflected wireless signal has been affected by the physical parameter acting on the acoustically active sensor.

2. The pumping system of claim 1, further comprising a sensor array module that aggregates data collected by the one or more sensors.

3. The pumping system of claim 2, wherein the pumping system further comprises:

a transmitter operably connected to the sensor array module;

and a receiver connected above the pump assembly.

4. The pumping system of claim 3, wherein the transmitter is configured to send a primary wireless data signal to the receiver and wherein the primary wireless data signal includes data representative of the measured parameter from the pumping system.

5. The pumping system of claim 4, wherein the wireless telemetry system further comprises a control unit located on the surface and wherein the receiver is configured to send a secondary wireless data signal to the control unit.

6. The pumping system of claim 5, wherein the primary wireless data signal and secondary wireless data signal are each selected from the group consisting of acoustic wave signals and radio wave signals.

7. The pumping system of claim 4, wherein the wireless telemetry system further comprises:

a control unit located on the surface;

one or more repeaters between the control unit and the receiver; and wherein the receiver is configured to send a secondary wireless data signal to the control unit through the repeaters.

8. The pumping system of claim 4, wherein the wireless telemetry system further comprises:

a control unit located on the surface;

a data cable extending between the control unit and the receiver; and wherein the receiver is configured to send a wired signal to the control unit through the data cable.

9. The pumping system of claim 1, wherein at least one of the one or more sensors comprises an acoustically active sensor.

10. The pumping system of claim 9, wherein each of the acoustically active sensors comprises a surface acoustic wave sensor.

11. The pumping system of claim 10, wherein each of the acoustically active sensors comprises:

an input transducer;

a delay field; and an output transducer.

12. The pumping system of claim 9, wherein the wireless telemetry system further comprises:

a control unit on the surface; and an interrogator.

13. The pumping system of claim 12, wherein the interrogator is an acoustic wave generator and an acoustic wave receiver.

14. A method for monitoring physical parameters within a pumping system deployed in a wellbore, the method comprising the steps of:

providing an acoustically active sensor within the pumping system;

providing an interrogator in wireless communication with the acoustically active sensor;

providing a control unit in communication with the interrogator;

transmitting an incident wireless signal from the interrogator;

receiving the incident wireless signal at the acoustically active sensor;

reflecting from the acoustically active sensor a reflected wireless signal, wherein the reflected wireless signal has been affected by the physical parameter acting on the acoustically active sensor;

and receiving the reflected wireless signal with the interrogator; and interpreting the differences between the incident wireless signal and the reflected wireless signal as a measurement of the physical parameter acting on the acoustically active sensor.

15. The method of claim 14, wherein the step of transmitting an incident wireless signal from the interrogator further comprises transmitting an incident acoustic wave.

16. The method of claim 14, wherein the step of transmitting an incident wireless signal from the interrogator further comprises transmitting an incident radio wave.

17. The method of claim 16, wherein following the step of transmitting an incident radio wave, the method further comprises the steps of:

transducing the incident radio wave at the acoustically active sensor to produce a surface acoustic wave on the acoustically active sensor;

permitting the surface acoustic wave to be distorted along a delay field on the acoustically active sensor; and transducing the distorted surface acoustic wave into a reflected radio wave.

18. A method for monitoring physical parameters of a pumping system deployed in a wellbore below the surface from a control unit located on the surface, the method comprising the steps of:

providing an acoustically active sensor within the pumping system;

providing an interrogator in wireless communication with the acoustically active sensor;

providing a control unit in communication with the interrogator;

transmitting an incident wireless signal from the interrogator;

receiving the incident wireless signal at the acoustically active sensor;

reflecting from the acoustically active sensor a reflected wireless signal, wherein the reflected wireless signal has been affected by the physical parameter acting on the acoustically active sensor;

providing a transmitter operably connected to the acoustically active sensor;

providing a receiver at a spaced apart distance from the transmitter within the pumping system;

transmitting a primary wireless data signal from the transmitter to the receiver that is representative of the measured condition; and transmitting a data secondary signal to the control unit on the surface from the receiver, wherein the secondary signal is representative of the measured condition.

19. The method of claim 18, wherein the step of transmitting a secondary data signal further comprises transmitting a secondary wireless data signal from the receiver to one or more repeaters located between the receiver and the control unit.

20. The method of claim 18, wherein the step of transmitting a primary wireless data signal further comprises transmitting an acoustic data signal to the receiver through the components of the pumping system.

* * * * *